US008096685B2

(12) United States Patent
Lu et al.

(10) Patent No.: US 8,096,685 B2
(45) Date of Patent: Jan. 17, 2012

(54) LED LAMP ASSEMBLY

(75) Inventors: Zhong-Liang Lu, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 375 days.

(21) Appl. No.: 12/412,371

(22) Filed: Mar. 27, 2009

(65) Prior Publication Data

US 2010/0102754 A1 Apr. 29, 2010

(30) Foreign Application Priority Data

Oct. 28, 2008 (CN) ..... 2008 1 0305255

(51) Int. Cl.
*F21V 13/04* (2006.01)

(52) U.S. Cl. ..... 362/276; 362/249.02; 362/555; 362/431

(58) Field of Classification Search ..... 362/276, 362/249.02, 249.11, 431, 414
See application file for complete search history.

(56) References Cited

U.S. PATENT DOCUMENTS

| | | | | |
|---|---|---|---|---|
| 5,155,668 | A * | 10/1992 | Tanner et al. | 362/183 |
| 5,588,735 | A * | 12/1996 | Harada | 362/102 |
| 6,942,361 | B1 * | 9/2005 | Kishimura et al. | 362/240 |
| 7,665,864 | B2 * | 2/2010 | Zheng et al. | 362/249.11 |
| 7,677,761 | B2 * | 3/2010 | Chiang | 362/240 |

FOREIGN PATENT DOCUMENTS

CN 2482627 Y 3/2002

* cited by examiner

*Primary Examiner* — Anabel Ton
(74) *Attorney, Agent, or Firm* — Altis Law Group, Inc.

(57) ABSTRACT

An LED lamp assembly includes a lighting pole and an LED lamp mounted on the lighting pole. The lighting pole includes a holding cylinder, a plurality of light-guiding plates received in the holding cylinder and a light emitting member surrounded by the light-guiding plates. The holding cylinder defines a plurality of through holes in a circumference sidewall thereof. A sensor is connected to the LED lamp, whereby the LED lamp lightens only when an object moves approaching the LED lamp assembly. Each light-guiding plate is semi-transparent. Light generated by the light emitting member partly transmits through a corresponding light-guiding plate and partly reflected thereby, whereby the lighting pole radiates an even light through the holes thereof. The lighting pole constantly radiates the even light during the operation of the LED lamp assembly.

18 Claims, 5 Drawing Sheets

LED LAMP ASSEMBLY

BACKGROUND

1. Technical Field

The disclosure relates to LED (light emitting diode) lamp assemblies for illumination purpose and, more particularly, relates to an improved LED lamp assembly having an intelligent controlling function, good heat dissipation capability and large illumination area.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Since LED lamps have many advantages, the LED lamps often act as street lamps for illumination purpose. Generally, the LED street lamps have two operation states, i.e., an "on" state and an "off" state. Once turning on, the LED street lamps will continuously provide constant light intensity even if there are no any goers or vehicles passing through the LED street lamps, which leads to a waste of electrical energy.

What is needed, therefore, is an improved LED street lamp assembly which can overcome the above problems.

BRIEF DESCRIPTION OF THE DRAWINGS

Other advantages and novel features of the disclosure will become more apparent from the following detailed description of an embodiment/embodiments when taken in conjunction with the accompanying drawings.

DETAILED DESCRIPTION

Figure 1:
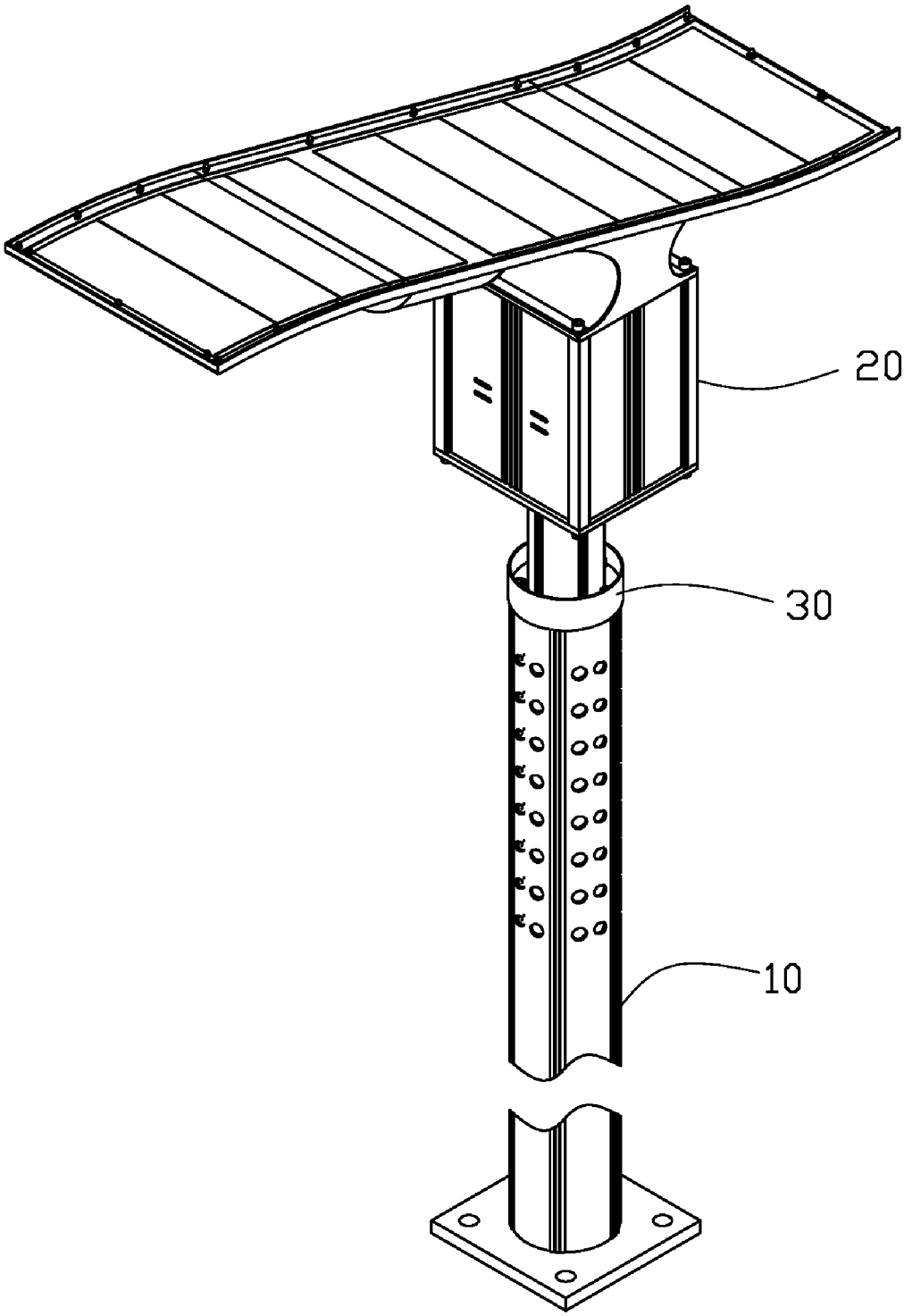
FIG. 1 is an isometric, assembled view of an LED lamp assembly in accordance with an embodiment of the disclosure.
Figure 2:
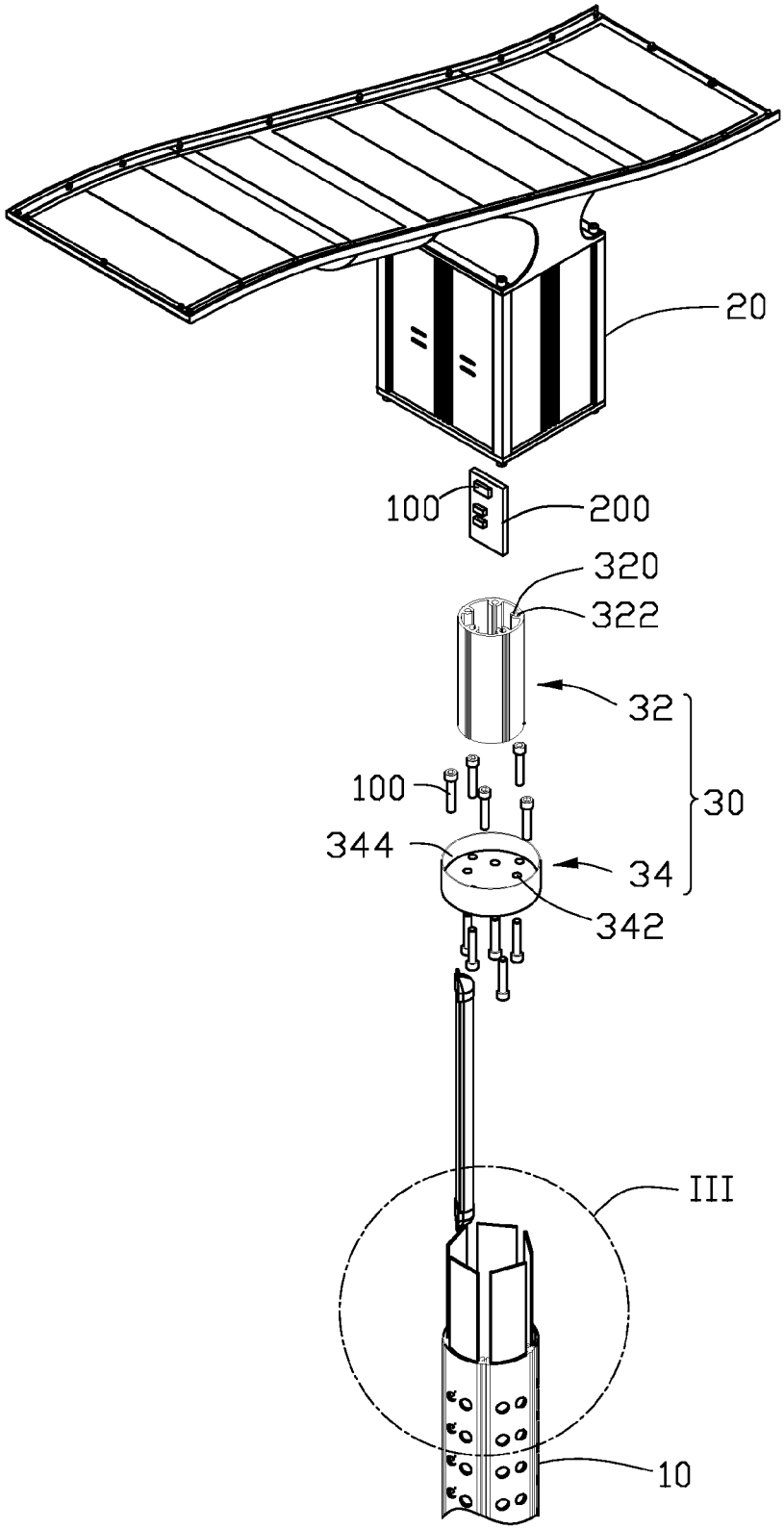
FIG. 2 is an exploded view of the LED lamp assembly of FIG. 1.

Referring to FIGS. 1-2, an LED lamp assembly in accordance with an embodiment is illustrated. The LED lamp assembly comprises a lighting pole 10, an LED lamp 20 and a connecting member 30 securing the LED lamp 20 on a top of the lighting pole 10.

Figure 3:
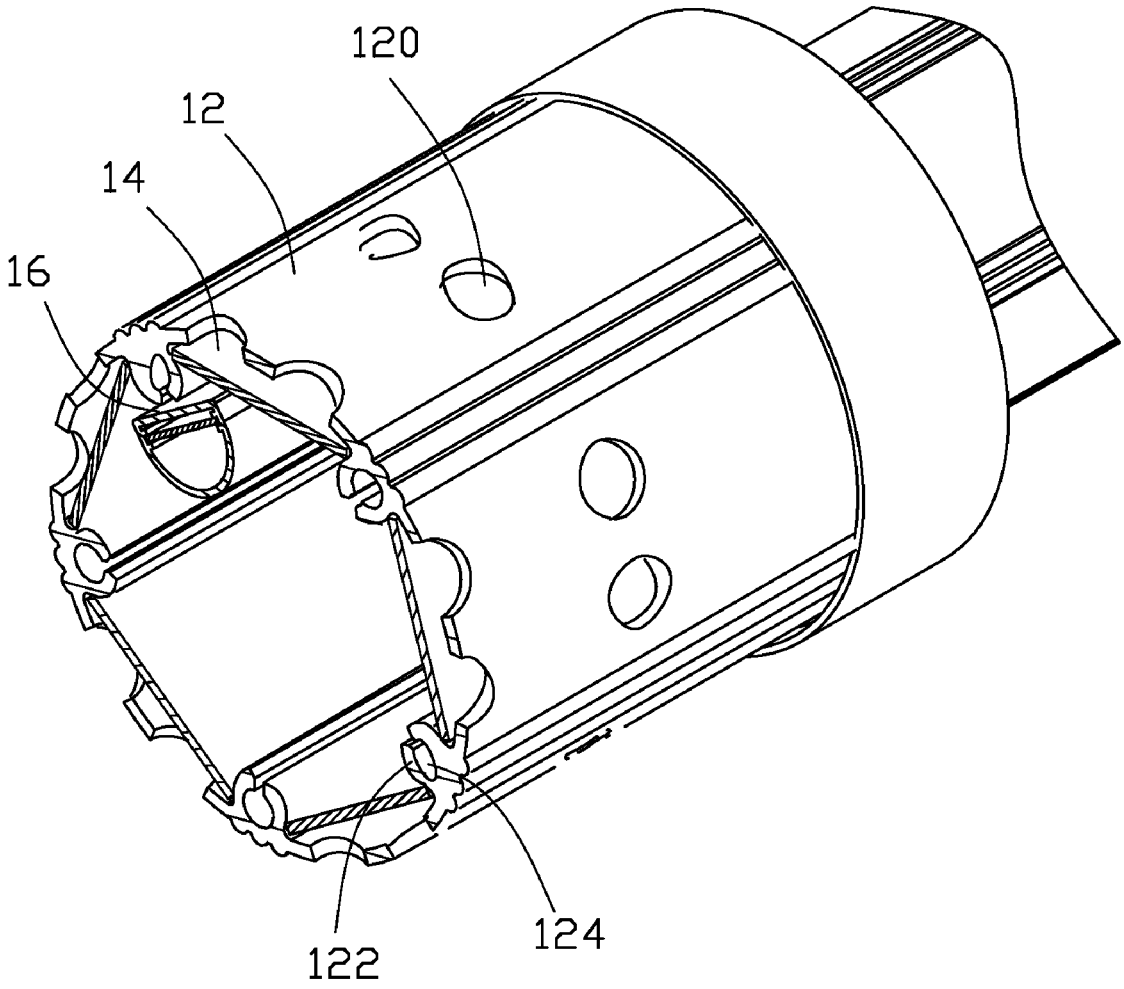
FIG. 3 is an isometric view of a lighting pole of the LED lamp assembly in FIG. 2, wherein a part of the lighting pole is cut away.
Figure 4:
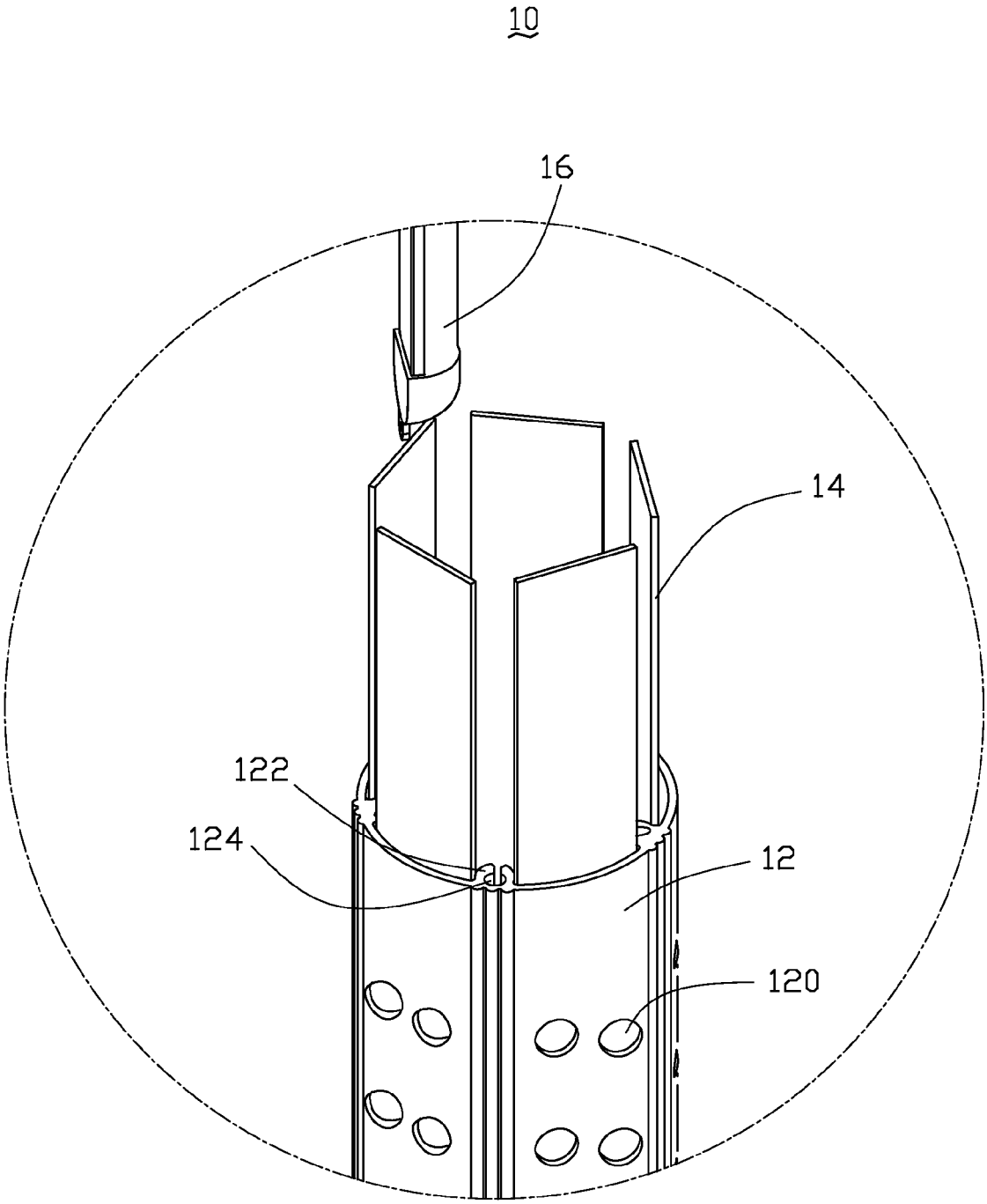
FIG. 4 is an enlarged view of a circled part III of the LED lamp assembly of FIG. 2.

Particularly referring to FIGS. 3-4, the lighting pole 10 comprises a holding cylinder 12 with a hollow hole (not labeled) therein, a plurality of light-guiding plates 14 fixed on an inner sidewall of the holding cylinder 12 and a light emitting member 16 received in the holding cylinder 12. A plurality of through holes 120 are evenly defined in a circumference sidewall of the holding cylinder 12 for light generated by the light emitting member 16 traveling therethrough to illuminate an ambient surrounding the holding cylinder 12. The holding cylinder 12 has a plurality of holding parts 122 protruding inwards from the inner sidewall thereof, for holding the light-guiding plates 14 therein. The holding parts 122 are spaced from each other with a constant distance. The holding parts 122 are arranged in the inner sidewall of the holding cylinder 12 along a length of the holding cylinder 12 and symmetrical to each other relative to an axis of the holding cylinder 12. Each of the holding parts 122 comprises two ribs (not labeled) extending curvedly and toward each other from the inner sidewall of the holding cylinder 12. Each holding part 122 defines a half closed engaging hole 124 between the two ribs thereof. The two ribs of each holding part 122 are slantwise to the inner sidewall of the holding cylinder 12 and at an acute angle to the inner sidewall of the holding cylinder 12, whereby two opposite long sides of each light-guiding plate 14 can be clipped between two neighboring holding parts 122 in the holding cylinder 12.

The light-guiding plates 14 are rectangular, thin plates made of semitransparent material for allowing a part of light generated by the light emitting member 16 to pass therethrough. Meanwhile, the light-guiding plates 14 reflect another part of the light generated by the light emitting member 16 toward other light-guiding plates 14. The light-guiding plates 14 are inserted into the holding cylinder 12 with the opposite long sides thereof being located between the corresponding ribs of the holding parts 122 and the inner sidewall of the holding cylinder 12. The light-guiding plates 14 are thus secured in the holding cylinder 12 and arranged over the inner sidewall of the cylinder 12 to evenly distribute the light generated by the light emitting member 16 to the through holes 120 of the holding cylinder 12. Thus, even if there is only one lightening source in the holding cylinder 12, i.e., the light emitting member 16, light can evenly radiate through all of the holes 120 of the holding cylinder 12 to have an aesthetically appealing effectiveness.

Figure 5:
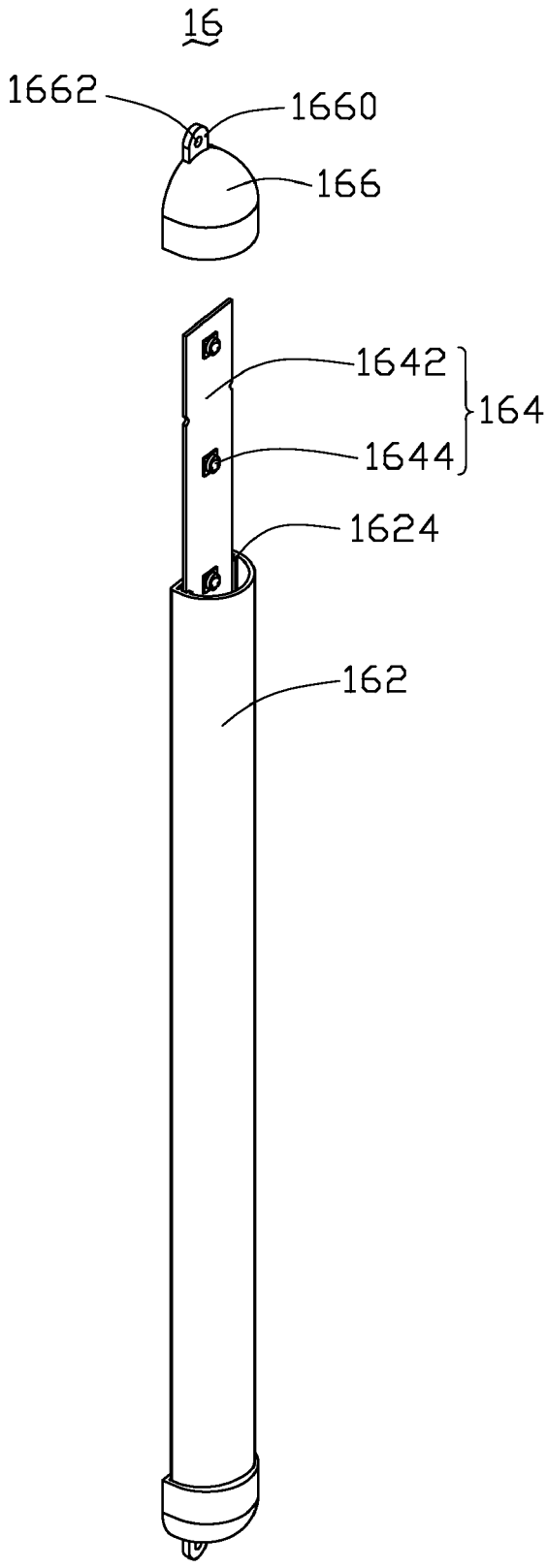
FIG. 5 is an enlarged, exploded view of a lighting emitting member of the LED lamp assembly in FIG. 2.

Also referring to FIG. 5, the light emitting member 16 is placed in the holding cylinder 12, located near one of the holding parts 122 and between two neighboring light-guiding plates 14. The light emitting member 16 is surrounded by the light-guiding plates 14 and comprises an envelope 162, an LED module 164 received in the envelope 162 and two caps 166 engaging with two opposite ends of the envelope 162. The envelope 162 has a semicircular cross section and is made of translucent material for light emitted by the LED module 164 passing therethrough. The envelope 162 has a flat plate (not labeled) and an arched plate (not labeled) connected to two opposite lateral sides of the flat plate. Two protruding strips 1624 facing each other extend inwards from an inner side of the arched plate and spaced from the flat plate with an equal distance. The LED module 164 comprises an elongated printed circuit board 1642 and a plurality of LED components 1644 mounted on one face of the printed circuit board 1642. The LED module 164 is securely received in the envelope 162 with the other face of the printed circuit board 1642 abutting against the flat plate of the envelope 162 and two opposite lateral sides of the printed circuit board 1642 being sandwiched between the two protruding strips 1624 and the flat plate. The two caps 166 respectively have two openings facing each other for receiving two opposite end portions of the envelope 162. A top one of the caps 166 has a lug 1660 formed at a top thereof, while a bottom one of the caps 166 has a lug 1660 formed at a bottom thereof. An extending hole 1662 is defined in the lug 1660 for a screw extending therethrough to engage with the ribs of a corresponding holding part 122 in the holding cylinder 12 to secure the light emitting member 16 in the holding cylinder 12.

Referring to FIGS. 1-2 again, the connecting member 30 comprises a connecting cylinder 32 and a circular connecting plate 34. The connecting cylinder 32 has a caliber smaller than that of the holding cylinder 12 and a plurality of vertical retaining posts 320 symmetrically formed at an inner sidewall thereof. Each retaining post 320 defines a retaining hole 322 therein. The connecting plate 34 has a flange 344 extending perpendicularly and upwardly from an edge thereof and defines a plurality of mounting holes 342 therein. The mounting holes 342 are arranged in an inner circle and an outer circle, respectively.

To assemble the LED lamp assembly, the connecting cylinder 32 is coupled to a bottom of the LED lamp 20 by a plurality of fixtures (not shown) extending downwardly through a bottom of the LED lamp 20 and being screwed into the retaining holes 322 at a top end of the connecting cylinder 32. A plurality of fixtures 100 extend upwardly through the mounting holes 342 arranged in the inner circle of the connecting plate 34 and then are screwed into the retaining holes 322 at a bottom end of the connecting cylinder 32, to thus couple the connecting plate 34 to the connecting cylinder 32. The connecting plate 34 is coupled to a top of the lighting pole 10 to complete an assembly of the LED lamp assembly by extending fixtures 100 downwardly through the mounting holes 342 arranged in the outer circle of the connecting plate 34 and screwing the fixtures 100 into the engaging holes 124 of the holding parts 122 of the holding cylinder 12 of the lighting pole 10.

To minimize a power consumption of the LED lamp assembly, the LED lamp assembly can be provided with an infrared/sound control sensor 100 mounted on a controlling and driving circuit board 200 receiving signal from the sensor 100 to switch the lamp 20 on or off to provide illumination with different intensities according to actual needs. When there is no goer near the LED lamp assembly, no intense illuminating light is needed and no signal is sent to the controlling and driving circuit board 200 to activate the lamp; thus, the lamp 20 are turned off except the lighting pole 10 which is kept generating decorative light for guiding goers far from the LED lamp assembly. When there is a goer approaches to the LED lamp assembly, the lamp is turned on to provide the goer with sufficient illuminating light. As the goer passes by and goes away from the LED lamp assembly, the sensor 100 stops sending out signals, whereby the LED lamp 20 is turned off. Thus, a waste of electrical energy is prevented.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp assembly, comprising:

a light pole capable of generating light comprising:

a holding cylinder defining a plurality of through holes in a circumference sidewall thereof and having a plurality of holding parts protruding inwards from an inner sidewall thereof;

a plurality of light-guiding plates received in the holding cylinder and each fastened by every two neighboring holding parts; and a light emitting member received in the holding cylinder, surrounded by the light-guiding plates and located at a position near two adjacent ones of the light-guiding plates, light generated by the light emitting member being reflected by at least one of the light-guiding plates to move through at least one of the through holes of the holding cylinder;

a sensor; and an LED lamp mounted on a top of the lighting pole, wherein during operation of the LED assembly, the LED lamp is controlled by the sensor to illuminate said LED lamp only at the time when an object moves approaching the LED lamp assembly, and the light emitting member constantly generates the light.

2. The LED lamp assembly as claimed in claim 1, wherein each light-guiding plate is clipped between two facing lateral sides of two corresponding neighboring holding parts.

3. The LED lamp assembly as claimed in claim 2, wherein two opposite lateral sides of each holding part are at an acute angle to the inner sidewall of the holding cylinder and fasten lateral sides of corresponding two neighboring ones of the light-guiding plates.

4. The LED lamp assembly as claimed in claim 3, wherein the holding parts are symmetrical to each other relative to an axis of the holding cylinder and each comprise two ribs extending curvedly and toward each other from the inner sidewall of the holding cylinder.

5. The LED lamp assembly as claimed in claim 4, wherein the lateral sides of the light-guiding plates are sandwiched between the ribs and the inner sidewall of the holding cylinder.

6. The LED lamp assembly as claimed in claim 1, wherein the light emitting member is located at an inner side of a corresponding holding part in the holding cylinder.

7. The LED lamp assembly as claimed in claim 6, wherein the light emitting member comprises an envelope, an LED module received in the envelope and two caps engaging with two opposite ends of the envelope.

8. The LED lamp assembly as claimed in claim 7, wherein the envelope has a semicircular cross section and has a flat plate, an arched plate connected to two opposite lateral sides of the flat plate and two protruding strips which face each other and extend inwards from an inner side of the arched plate and are spaced from the flat plate with an equal distance.

9. The LED lamp assembly as claimed in claim 8, wherein the LED module comprises an elongated printed circuit board having two opposite lateral sides of the printed circuit board being sandwiched between the two protruding strips and the flat plate and a plurality of LED components mounted on the printed circuit board and facing the arched plate.

10. The LED lamp assembly as claimed in claim 9, wherein the two caps respectively have two openings facing each other to receive two opposite end portions of the envelope and each have a lug which is formed at an end thereof remote from the envelope, each cap defining an extending hole in the lug for a screw extending therethrough to engage with a corresponding holding part in the holding cylinder.

11. The LED lamp assembly as claimed in claim 1, further comprising a connecting member coupling the LED lamp to the top of the lighting pole, wherein the connecting member comprises a connecting cylinder having an upper end connected to a bottom of the LED lamp and a connecting plate coupling the lighting pole and the connecting cylinder together.

12. The LED lamp assembly as claimed in claim 11, wherein each holding part defines therein a half closed engaging hole engagingly receiving a corresponding fixture extending downwardly through the connecting plate.

13. A lighting fixture comprising:

a light pole capable of generating light comprising:

a holding cylinder defining a plurality of through holes in a circumference sidewall thereof and having a plurality of holding parts protruding inwards from an inner sidewall thereof;

a plurality of light-guiding plates received in the holding cylinder and fastened by every two neighboring holding parts, wherein each light-guiding plate is semitransparent and permits light to pass therethrough and reflects light; and an LED module received in the holding cylinder and surrounded by the light-guiding plates;

an LED lamp connected to the light pole, wherein during an operation of the lightening fixture, the LED lamp is turned on to generate light when an object moves approaching the LED lamp, and the LED module of the light pole constantly generates light.

14. The lighting fixture as claimed in claim 13, wherein each light-guiding plate is clipped between two facing lateral sides of two neighboring holding parts.

15. The lighting fixture as claimed in claim 14, wherein two opposite lateral sides of each holding part are at an acute angle to the inner sidewall of the holding cylinder and fasten lateral sides of two corresponding neighboring ones of the light-guiding plates.

16. The lighting fixture as claimed in claim 15, wherein the holding parts are symmetrical to each other relative to an axis of the holding cylinder and each comprise two ribs extending curvedly and toward each other from the inner sidewall of the holding cylinder.

17. The lighting fixture as claimed in claim 16, wherein the lateral sides of the light-guiding plates are sandwiched between the ribs and the inner sidewall of the holding cylinder.

18. The lighting fixture as claimed in claim 13, wherein the light emitting member is located at an inner side of a corresponding holding part in the holding cylinder and located between two neighboring holding parts.

* * * * *